United States Patent [19]

Golowash

[11] Patent Number: 4,806,716

[45] Date of Patent: Feb. 21, 1989

[54] HIGH VOLTAGE CONTACT ASSEMBLY

[75] Inventor: Victor Golowash, Birmingham, Ala.

[73] Assignee: Electrical Equipment, Inc., Birmingham, Ala.

[21] Appl. No.: 54,229

[22] Filed: May 26, 1987

[51] Int. Cl.[4] ..... H01H 1/22

[52] U.S. Cl. ..... 200/244; 200/48 KB; 200/278

[58] Field of Search ..... 200/278, 48 KB, 254, 200/244, 162

[56] References Cited

U.S. PATENT DOCUMENTS

| | | | |
|---|---|---|---|
| 368,221 | 8/1887 | McDaniel | 200/254 |
| 2,063,954 | 12/1936 | Ramsey | 200/162 |
| 3,676,629 | 7/1972 | Evans | 200/254 |
| 4,263,487 | 4/1981 | Welter | 200/48 KB |
| 4,281,228 | 7/1981 | Harmon | 200/51 R |
| 4,553,008 | 11/1985 | Veverka et al. | 200/148 R |

FOREIGN PATENT DOCUMENTS

| | | | |
|---|---|---|---|
| 1285302 | 12/1960 | France | 200/254 |

OTHER PUBLICATIONS

Paper for Presentation at the Holm Seminars on Electric Contact Phenomena, Oct. 18, 1973.

*Primary Examiner*—Renee S. Luebke

*Attorney, Agent, or Firm*—Jennings, Carter, Thompson & Veal

[57] ABSTRACT

A multi-position contact for use in high voltage switchgear utilizes a multi-laminar electrical contact and a movable contact blade to maintain continuous electrical contact with a first circuit component and a switch blade assembly movable concomitantly with said movable contact blade for selective connection to second or third circuit components.

4 Claims, 2 Drawing Sheets

Fig. 1
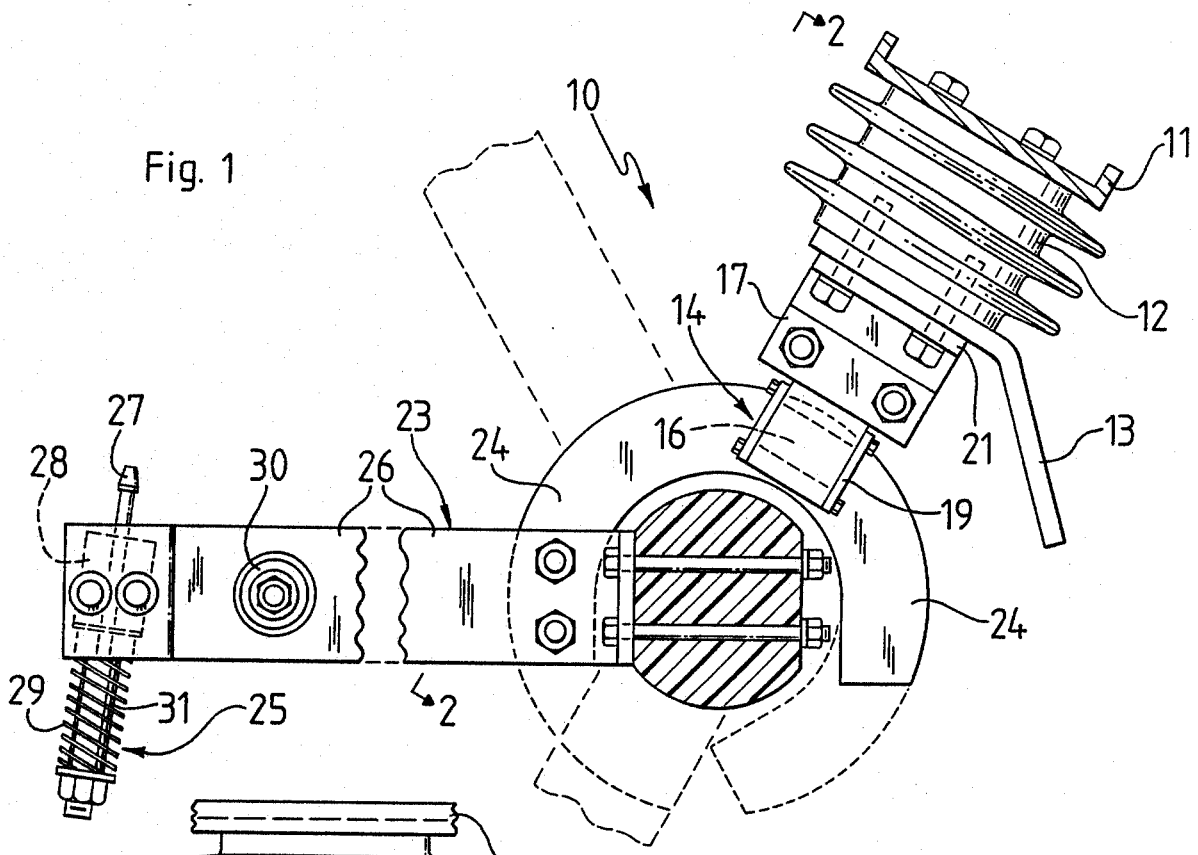
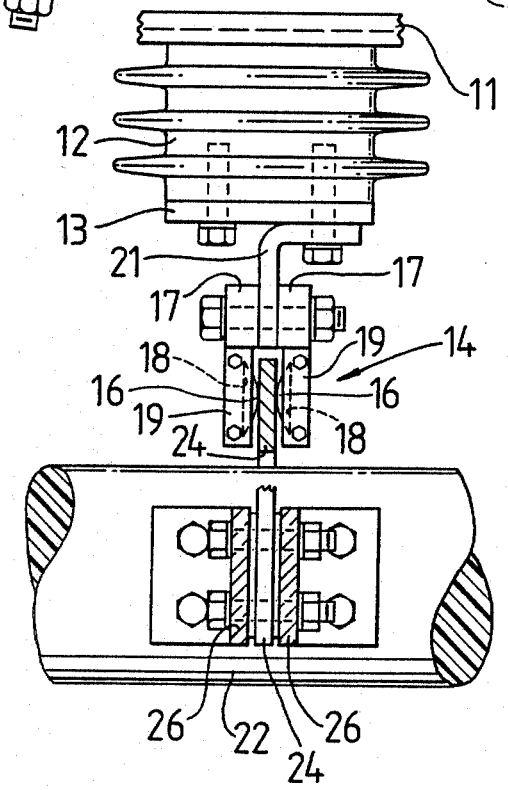
Fig. 2
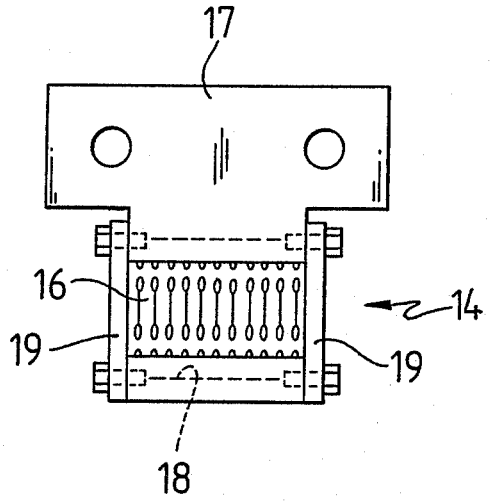
Fig. 3

HIGH VOLTAGE CONTACT ASSEMBLY

FIELD OF THE INVENTION

The present invention relates generally to electrical switchgear and more particularly to a multi-position contact for use in electrical switchgear. In even greater particularity, the present invention relates to a multi-position contact utilizing a multi-laminar contact element.

Multi-laminar electrically conductive materials are well known in the art and possess numerous desirable characteristics, as noted in a paper presented by the Multilam Corporation in a Paper for Presentation at the Holm Seminars on Electric Contact Phenomena at the Illinois Institute of Technology in October 1973. Nonetheless, their application in high voltage switchgear have been limited by the necessity of the switchgear making and breaking electrical contact. As is well known, such materials suffer rapid deterioration in such circumstances and therefore cannot be used at the point where the switchgear opens and closes.

Conventional switchgear is also limited in that the normal range of motion of such is from an open circuit position to a closed circuit position.

SUMMARY OF THE INVENTION

It is the object of the present invention to provide an improved contact assembly for high voltage switchgear utilizing a continuous contact.

Another object of the invention is to provide a contact assembly which can be utilized in a switchgear having more than one closed position.

Another object of the present invention is to provide a contact assembly which can be used in an air or sulfur-hexachloride ($SF_6$) environment.

These and other objects and advantages of my invention are accomplished through the novel provision of a sickle shaped contact as a slidable contact in cooperation with a fixed contact. The fitted contact is stationary and remains in constant engagement with a curved contact bar mounted about the axis of rotation of a blade contact which is movable between an open position and a first or second closed position. The contact bar and blade contact move concomitantly with the contact bar remaining in electrical contact with the fixed contact throughout the entire range of motion, thereby preventing any arcing therebetween.

BRIEF DESCRIPTION OF THE DRAWINGS

Apparatus embodying features of my invention are depicted in the accompanying drawings which form a portion of this application and wherein:

FIG. 1 is a side elevation of the contact assembly;

FIG. 2 is a partial elevation taken along line 2—2 of FIG. 1;

FIG. 3 is a detail view of the multi-lam contact holder; and

DESCRIPTION OF A PREFERRED EMBODIMENT

Figure 4:
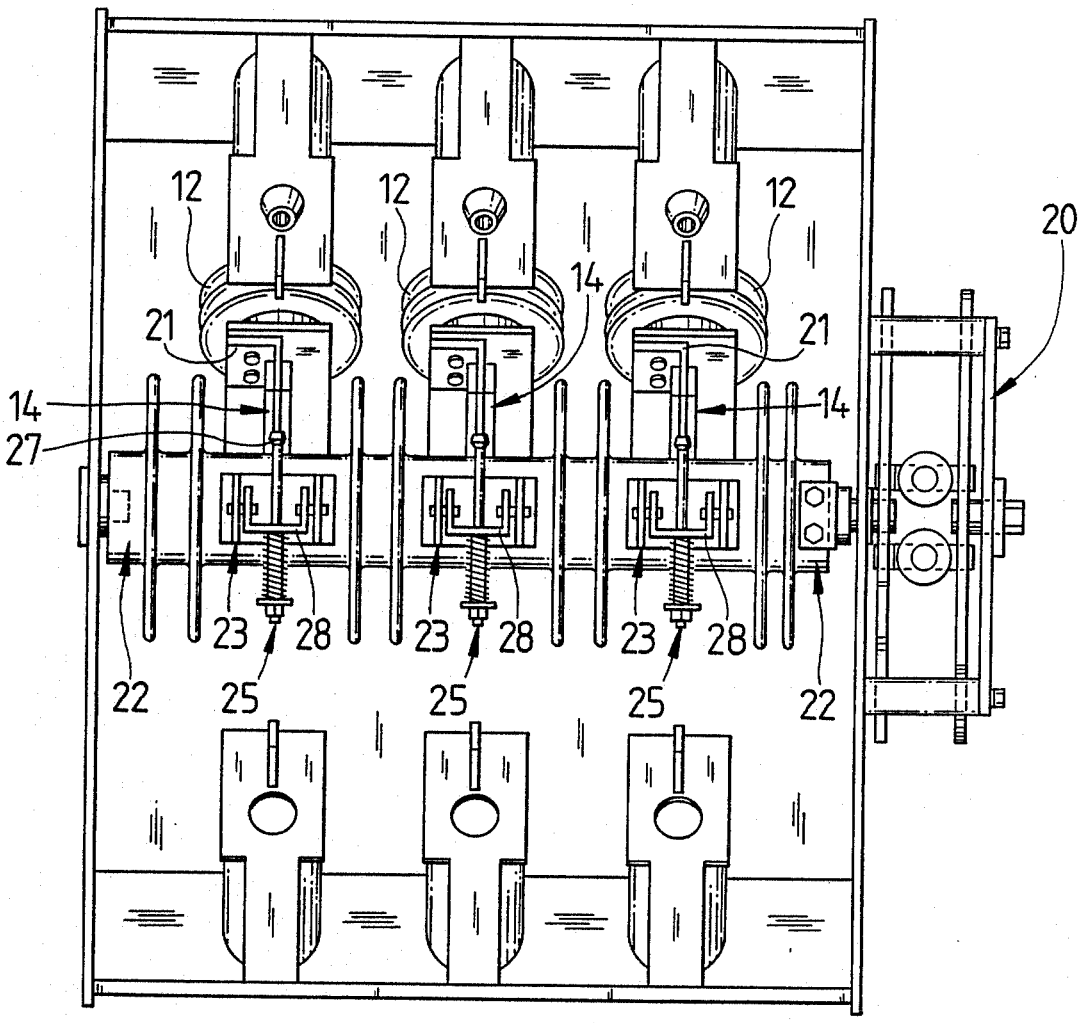
FIG. 4 is a front elevational view of the contact assembly and an operator.

The present invention is a contact assembly 10 such as may be used in a multi-position switchgear as shown in my U.S. patent application Ser. No. 054,228, now U.S. Pat. No. 4,761,524, filed concurrently herewith and which is incorporated herewith by reference. With reference to FIG. 1, it may be seen that I provide a mounting bracket 11 for attachment to said switchgear, an insulator 12 made from a material made from a modified cycloaliphatic resin to electrically isolate the contact assembly 10 from the remainder of the switchgear, and a stationary contact 13 for connecting the contact assembly 10 to an electrical conductor or some electrical load, as is well known.

The stationary contact 13 supports a fixed electrical contact assembly 14 which may include a pair of strips of multi-laminar electrical conductor, hereinafter referred to as 16. The strips 16 may be made of plated beryllium bronze and is commercially available from Hugin Industries of Los Altos, Calif. A holder 17 is provided to support each strip 16. Each holder has a dove-tail groove 18 formed therein such that the strip 16 may be inserted with the edges thereof confined within the groove 18. A pair of stop plates 19 secure the strip 16 within the groove 18. The holders 17 are secured to the stationary contact 13 by an angle connection 21 such that the assembly 14 remains fixed relative to the remainder of the switchgear.

A shaft 22 also made of modified cycloaliphatic is mounted in the switchgear proximal the assembly 14. The shaft 22 is rotatable about its longitudinal axis and affixed thereto a blade assembly 23 which moves concomitantly with shaft 22. The blade assembly 23 includes an arcuate contact blade 24, made of copper which extends a predetermined distance around the shaft 22 in spaced relation thereto. Contact blade 24 passes between the holders 17 of the assembly 14 such that the strip 16 presses against the sides of the contact blade 24. The contact blade 24 is secured between a pair of switch blades 26 affixed to shaft 22 and extending radially therefrom. The switch blades 26 are biased towards one another by blade springs 30 and carry a probe assembly 25 distal the shaft 22 on a probe support bracket 28 as is well known and as is disclosed in U.S. Pat. No. 4,263,487 owned by the common assign of this application and incorporated herein by reference. The probe assembly 25 includes a probe 27 biased by a compression spring 29 positioned about a probe sleeve 31. The probe 27 is adapted for cooperation with a first closed contact in the switchgear when the shaft 22 is rotated in a first direction as described in U.S. Pat. No. 4,263,487 incorporated by reference earlier. The spring end of the probe assembly 25 is adapted for engagement with a second closed contact of the switchgear when the shaft 22 is rotated in a second direction. The shaft 22 and blade assembly 24 are preferentially rotated by an operating mechanism 20, shown in FIG. 4. as described in my U.S. patent application Ser. No. 054,228 now U.S. Pat. No. 4,761,524 filed concurrently herewith. As noted thereon, the operator mechanism 20 allows the blade 24 to contact either of the closed contacts in the switch gear or neither of these contacts.

As may be seen, the contact blade 24 must extend about the shaft 22 sufficiently to remain in contact with the strips 16 at all times and must maintain a constant radial position relative to the shaft 22 for the same reason. In the preferred embodiment, the range of motion of the shaft 22 is approximately 120° about its axis. Therefore, the contact blade 24 must extend at least 120° about the shaft 22.

From the foregoing, it may be seen that the contact blade 24 and contact assembly 14 cooperate to provide continuous electrical connection throughout the entire range of motion of the switch blades 26 and the blade assembly 23 mounted on shaft 22 provides a selective electrical connection at either end of the range of motion and an open condition intermediate these positions. When used in conjunction with my aforementioned operating mechanism, this contact assembly provides excellent three position switch capabilities.

While I have shown my invention in one form, it will be obvious to those skilled in the art that it is not so limited but is susceptible to various changes and modifications without departing from the spirit thereof.

What I claim is:

1. A contact assembly for use in a high voltage switchgear comprising (a) a sickle-shaped blade assembly, having a curved portion with a center of curvature and an elongated blade member with a linear end, mounted for rotation about the center of curvature of the curved portion thereof, having its linear end adapted for engagement with a circuit component upon rotation in either direction; and (b) a fixed contact assembly engaging said curved position of said sickle-shaped blade assembly providing constant electrical contact with another circuit component during rotation of said sickle-shaped blade assembly.

2. A contact assembly as defined in claim 1 wherein said sickle-shaped blade assembly comprises:

(a) an electrically non-conductive shaft mounted for driven rotation in said switchgear;

(b) said elongated blade member affixed to said shaft for concomitant rotation therewith and extending radially therefrom; and (c) said curved portion affixed to said blade member for concomitant motion therewith, with said curved portion extending about said shaft a predetermined angular distance less than 360°.

3. A multi-position contact assembly for a high voltage switch comprising:

(a) an electrically conductive blade member including an arcuate member having a center of curvature, an inner and outer radius of curvature and a blade portion extending radially from said arcuate member, with said blade member mounted for rotation concomitantly with an insulated shaft about an axis through the center of curvature of said arcuate member, said arcuate member being spaced from said shaft;

(b) a first stationary electrically conductive contact cooperatively positioned at a fixed radial distance from said axis intermediate the inner and outer radius of curvature of said arcuate member for constant sliding contact with said arcuate portion; and (c) second and third stationary electrically conductive contact member located at a fixed radial distance from said axis such that said blade member may be selectively moved about said axis to engage said blade portion with either said second or third electrically conductive contact members distal said arcuate portion, whereby said first stationary electrically conductive contact may be selectively electrically connected to either or neither one of said second and third selectively electrically conductive contacts.

4. A multi-position contact assembly as defined in claim 3 further comprising operator means for selectively urging said electrically conductive blade member to a position engaging one of said second and third stationary electrically conductive contact members and to a position disengaged from both of said second and third stationary electrically conductive contact members.

* * * * *